US006637044B2

(12) United States Patent
Rische et al.

(10) Patent No.: US 6,637,044 B2
(45) Date of Patent: Oct. 28, 2003

(54) STATEMENT REGARDING FEDERALLY SPONSORED RESEARCH/DEVELOPMENT

(75) Inventors: David K. Rische, Sheboygan, WI (US); Kyle L. Hokel, Sheboygan Falls, WI (US); Virgil S. Eickhoff, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/075,190

(22) Filed: Feb. 14, 2002

(65) Prior Publication Data

US 2003/0150053 A1 Aug. 14, 2003

(51) Int. Cl.[7] ..... E03D 5/00
(52) U.S. Cl. ..... 4/405
(58) Field of Search ..... 4/405, 411–414

(56) References Cited

U.S. PATENT DOCUMENTS 1,334,173 A * 3/1920 Saal ..... 4/414
1,454,428 A * 5/1923 Curtin ..... 4/405
1,519,796 A * 12/1924 Pasman ..... 4/414
1,548,759 A * 8/1925 Sherwood ..... 4/405
1,555,620 A 9/1925 Ayers et al.
1,620,647 A * 3/1927 Griffiths ..... 4/414
1,902,758 A * 3/1933 Campbell ..... 4/414
3,406,408 A 10/1968 Hudson
3,419,912 A 1/1969 Kertell
3,922,731 A 12/1975 Korol
4,575,881 A 3/1986 Rozek
4,750,220 A * 6/1988 Baumann ..... 4/405 X

* cited by examiner

*Primary Examiner*—Charles E. Phillips
(74) *Attorney, Agent, or Firm*—Charles & Brady LLP

(57) ABSTRACT

A toilet trip lever assembly provides a lever arm that extends in the tank perpendicular to the tank wall. As an outer handle is rotated, it drives a stem, which in turn drives an arm inside the tank that extends parallel to the tank wall, which pushes down an end of a lever. A support holds the lever such that downward movement of that end of the lever drives the opposite end of the lever up. The opposite end of the lever is connected to a linkage to a flush valve.

10 Claims, 6 Drawing Sheets

STATEMENT REGARDING FEDERALLY SPONSORED RESEARCH/DEVELOPMENT

CROSS-REFERENCE TO RELATED APPLICATION

Not applicable.

STATEMENT REGARDING FEDERALLY SPONSORED RESEARCH/DEVELOPMENT

Not applicable.

BACKGROUND OF THE INVENTION

The present invention relates to trip lever assemblies. It is especially well suited to provide toilet trip lever assemblies that control flush valves that are located at or near the bottom of toilet tanks.

A variety of toilet trip lever assemblies are well known. These assemblies are typically mounted on a side wall of a toilet tank with a handle positioned outside the tank and linked to a stem. The stem is rotatably mounted through the tank wall. A trip arm (which typically extends along the tank wall from the stem) is connected to the stem inside the toilet tank.

One end of the trip arm is connected to a chain, which in turn is linked to the usual toilet tank outlet valve. When a user rotates the handle, the trip arm is caused to pivot, thereby moving up its outer end, which in turn yanks the chain up, and thus the tank outlet valve.

Depending upon space limitations in the tank, and the exterior configuration of the tank desired, it is sometimes desirable that rotation of the handle produce a pivoting of the trip arm in a plane which is perpendicular (not parallel) to the wall through which the lever is mounted. There have been some assemblies which have achieved this result.

For example, U.S. Pat. No. 1,555,620 provided a toilet trip lever in which both the outer handle and the inner lever arm pivoted perpendicular to the tank wall. Unfortunately, this required the handle to jut out a significant distance from the tank wall, and provided poor leverage characteristics.

U.S. Pat. No. 3,419,912 disclosed an improved perpendicular type toilet trip lever (where the outer handle rotated in a conventional manner). A very short arm pivoted with the stem that passed through the wall. That arm in turn pushed up a perpendicular lever arm that was supported on a bracket. Because of the construction of the mechanism, a relatively large angle of rotation of the handle was required to activate the valve. Furthermore, the device was relatively costly to manufacture and assemble.

U.S. Pat. No. 4,575,881 provided another perpendicular type toilet trip lever. However, the parts of that assembly were somewhat difficult to adjust to account for certain variations in the toilet wall thickness. Also, certain of the plastic parts could break if not carefully handled.

Therefore, a need still exists for an improved "perpendicular" type toilet trip lever assembly.

SUMMARY OF THE INVENTION

In one aspect the present invention provides a trip lever assembly mountable through a hole of a tank wall. There is a rotatable stem extendable through the hole, a handle mountable to an outer end of the stem, and an arm mountable to an inner end of the stem so as to rotate with the stem, the arm then being extendable along the wall.

There is also a support mountable inside the tank, and a lever mountable for pivoting on the support, with the lever then extending from a position adjacent the wall towards a position farther away from the wall. When the trip lever assembly is mounted through said tank wall hole, rotation of the handle can cause the arm to drive an end of the lever which is adjacent the wall down, and an opposite end of the lever up.

In preferred forms there is a chain linked to the opposite end of the lever and a flush valve link to the chain. Also, the stem can be surrounded by a bushing, and the bushing can cooperate with the handle to limit rotational movement of the handle. The bushing can be outwardly threaded, and a nut can be provided with internal threads to thread onto the bushing threads.

There can also be an escutcheon positionable adjacent the handle outside the tank wall, the escutcheon having a locating member for locating the escutcheon in the hole of the tank wall. The bushing can include ribs or ridges sized and dimensioned to deform as they are inserted into the escutcheon to provide a tight fit.

In especially preferred forms a contact surface of each of the arm and lever (which contact each other) are a rolled surface, the support is an L-bracket with a mounting hole for mounting the L-bracket over the hole in the wall, the mounting hole includes a rolled tab, and the support has another hole into which the arm projects.

In another aspect the invention provides a combined toilet tank and trip lever assembly. There is a tank having a bottom wall and surrounding side walls. There is a hole through a side wall. There is also a flush valve mounted in a lower portion of the tank.

A rotatable stem extends through the hole in the tank side wall, a handle is mounted to an outer end of the stem, and an arm is mounted to an inner end of the stem so as to rotate with the stem, the arm then extending essentially parallel to the side wall through which the stem extends.

There is also a support mounted inside the tank. A lever is mounted for pivoting on the support, with the lever then extending essentially perpendicular to the side wall through which the stem extends between a position adjacent that wall towards a position farther away from that wall. Rotation of the handle causes the arm to drive a part of the lever down, and an opposite part of the lever up.

The location of the pivot point along the support is such that a relatively small angle of rotation of the stem causes the lever to lift the chain sufficiently to flush the toilet. Rotation of the stem beyond the desired point is limited by interaction of the handle and bushing, thereby preventing the arm from "clinking" or "tapping" on the bottom side of the tank lid.

The advantage of the present invention therefore include, without limitation, providing a perpendicular type toilet trip lever which is easy to produce, easy to assemble, inexpensive, and reliable. Relatively small movement of the handle creates the necessary movement of the chain. Still other advantages of the present invention will be apparent from the description below.

DETAILED DESCRIPTION OF THE PREFERRED EMBODIMENT

Figure 1:
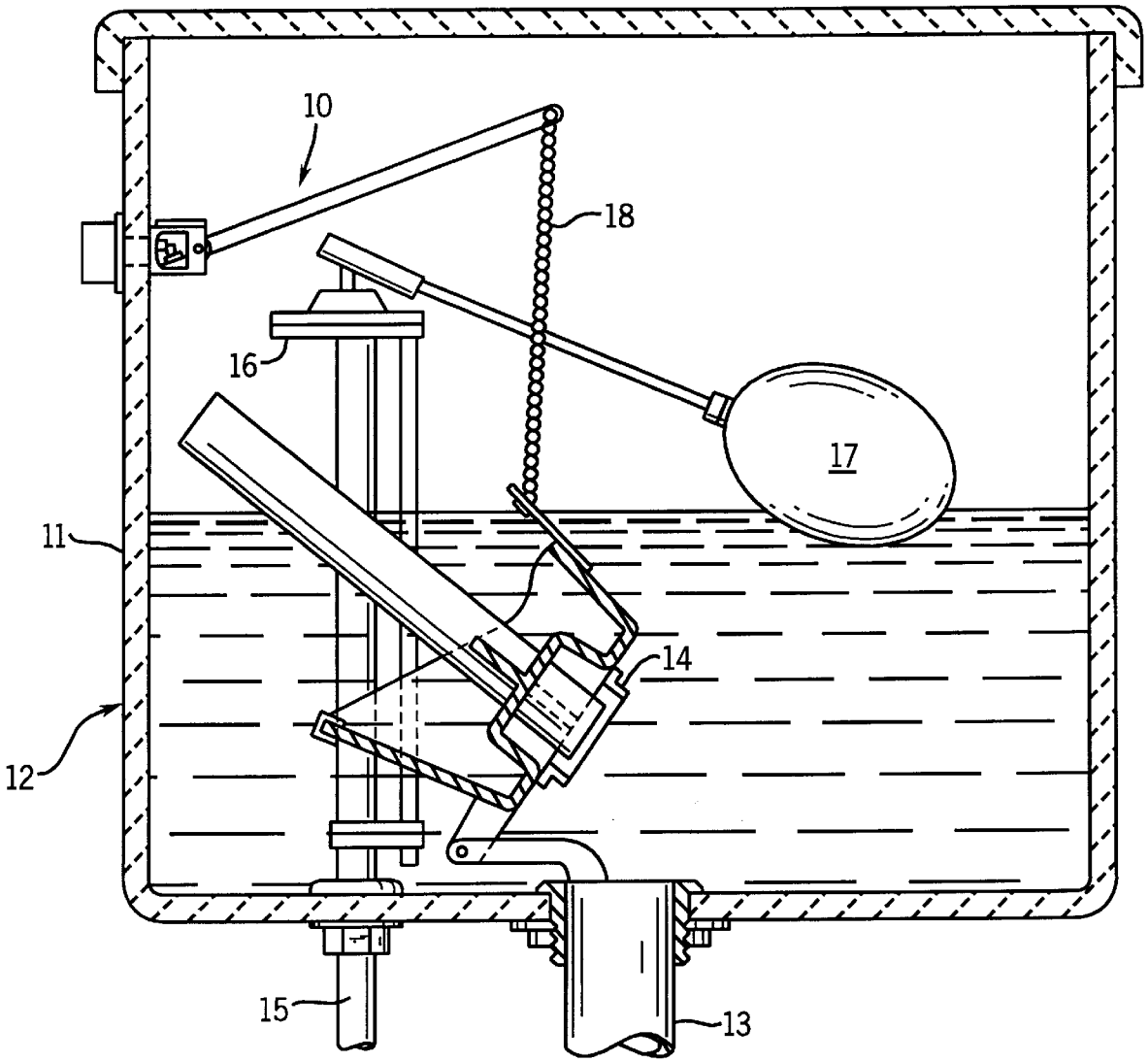
FIG. 1 is a view, partially in vertical cross section, of a toilet tank employing a trip lever assembly of the present invention, with the lever assembly mounted on a side wall.

FIG. 1 shows a toilet trip lever assembly 10 of the present invention mounted on a side wall 11 of a conventional toilet tank 12. An outlet pipe 13 leads to the usual toilet bowl (not shown), and is sealed by an outlet flush valve 14. It should be appreciated that the specifics of the flush valve mechanism are not critical, and that a wide variety of other such mechanisms which are activated by an upward yank can be used with the present invention.

The usual inlet pipe 15 is connected to a conventional inlet valve 16, which is controlled by a float 17 in a conventional manner. A chain 18 or other linkage connects the trip assembly 10 of the present invention to the outlet flush valve 14, to control lifting of the outlet valve 14 off of its seat when the trip assembly 10 is operated. Lifting the valve 14 off of its seat on the outlet pipe 13 causes the toilet to flush, as is well known.

Figure 2:
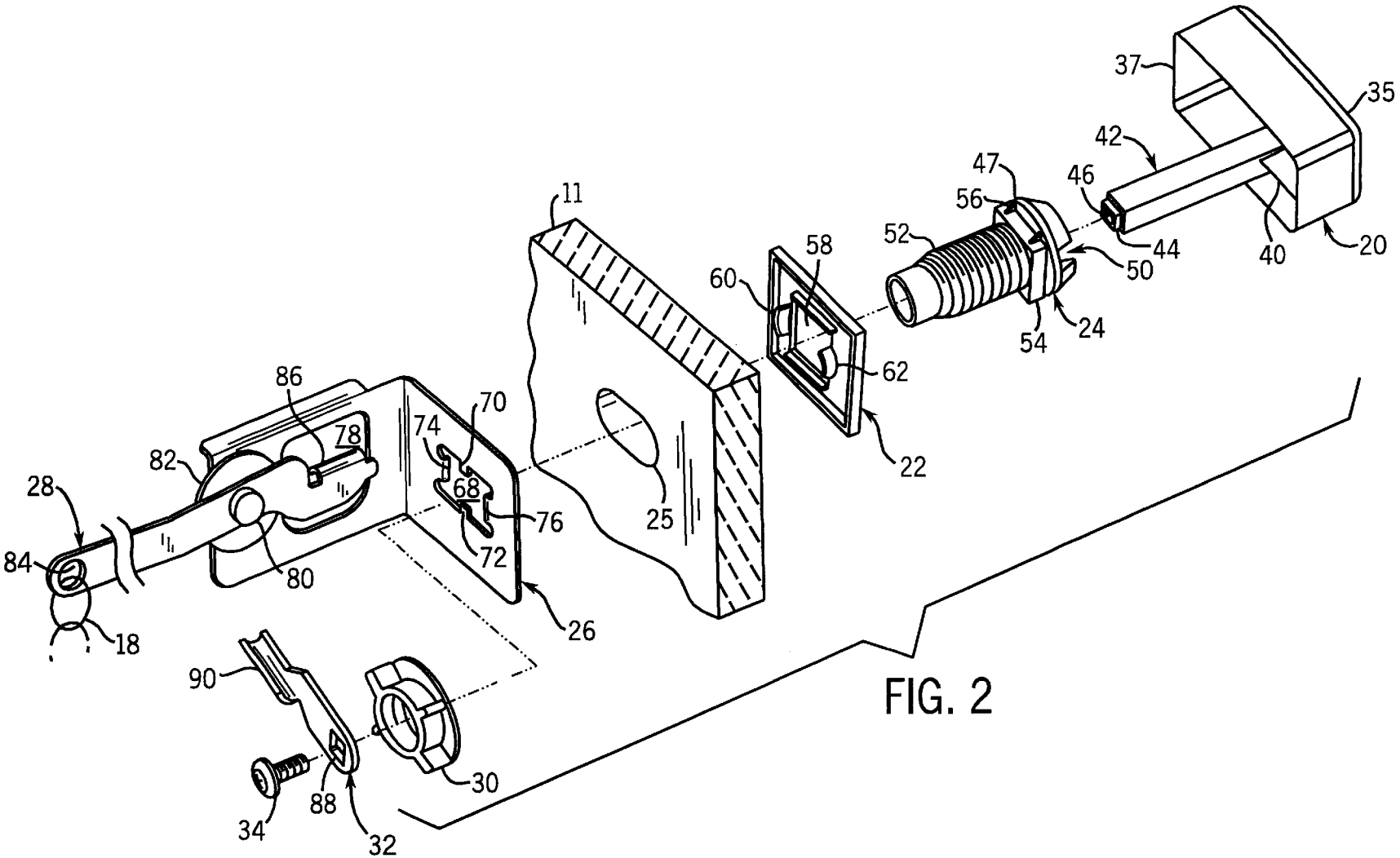
FIG. 2 is an exploded view of the trip lever assembly, with a fragmented portion of the tank wall also shown.
Figure 3:
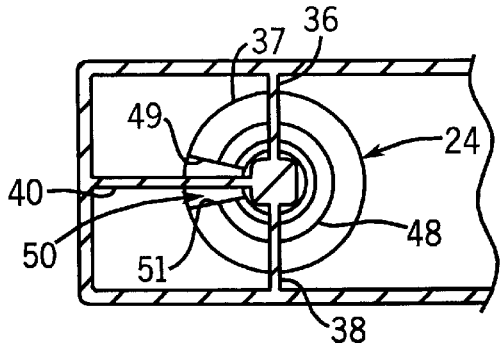
FIG. 3 is a sectional view taken along line 3—3 of FIG. 4.
Figure 4:
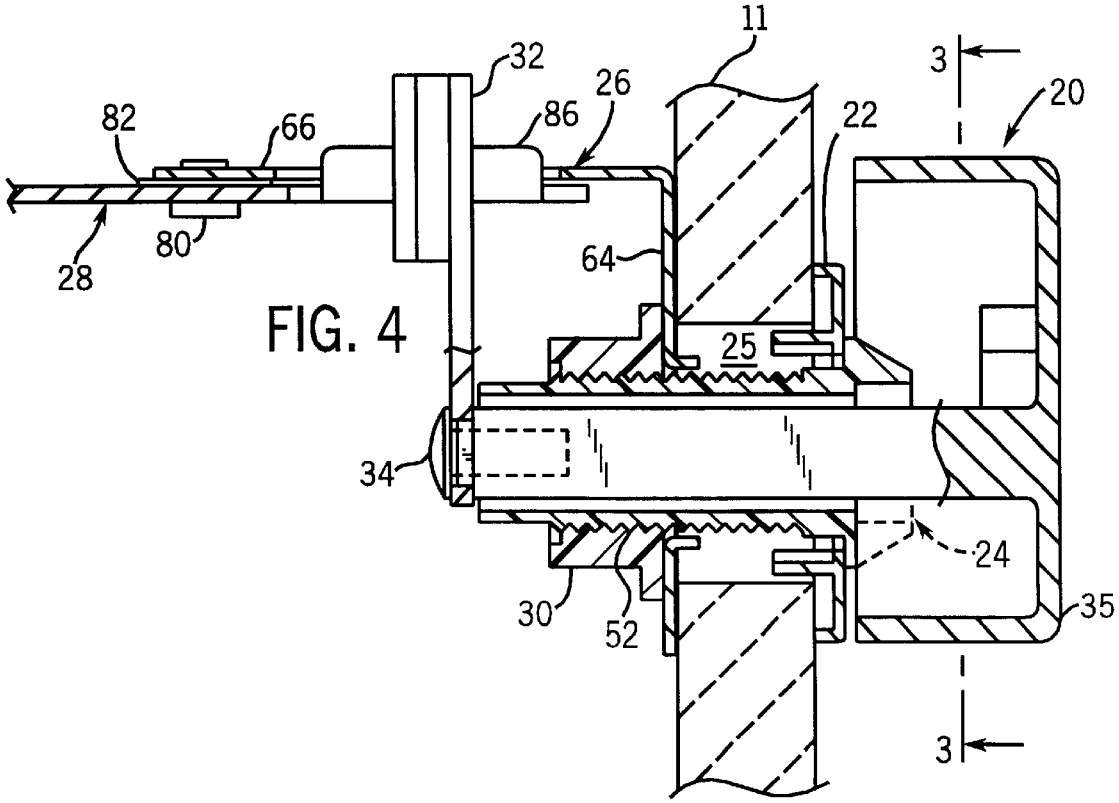
FIG. 4 is a view taken along line 4—4 of FIG. 6.

Referring now to FIG. 2, an exploded view of the toilet trip lever assembly 10 of the present invention is shown. An actuating assembly has a handle 20, a bushing 24, and a rotatable trip pin 32. The pin 32 is coupled to a stem 42 of the handle 20 with a threaded fastener 34. The handle 20 is provided on the outside of the tank wall 11, with a decorative escutcheon 22, while the bushing 24 and trip pin 32 extend through an aperture 25 of the toilet tank wall 11.

An arm assembly has an L-bracket 26 and lever arm 28, which pivots about a pin 80. The L-bracket is located inside the toilet tank against the wall 11. The actuating assembly and arm assembly are clamped to the tank wall with a nut 30 threading onto threads 52 of the bushing 24.

The handle 20 is preferably substantially rectangular, with a planar front wall 35 and side walls 37. First and second vertical cross bars 36 and 38 extend from the top and bottom side walls 37 to a stem 42 positioned at a substantially central location between the top and bottom wall. The stem 42 extends from the front wall 35 of the handle 20 in a direction substantially perpendicular to the front wall 35. A horizontal cross bar 40 extends from a side wall 37 to the stem 42. The horizontal cross bar 40 acts as a rotational stop for the handle 20 as described more fully below.

The distal end of the stem 42 includes a threaded receptacle 46 and a generally rectangular locator element 44 sized and dimensioned to mate with the rotatable trip pin 32. The bushing 24 is received in the handle 20. The outwardly facing end of the bushing 24 comprises a planar circular element 47 that includes a generally circular ridge 48 extending outward in a direction substantially perpendicular to the planar element 47.

An opening 50 defined in the circular ridge 48 provides first and second stop elements 49 and 51. The stop elements 49 and 51 work with the horizontal cross bar 40 in the handle 20 to limit rotation of the handle 20. The back side of the bushing 24 comprises a threaded sleeve 52, a square mounting section 54 and associated "crush ribs" or ridges 56. The square mounting section 54 is sized and dimensioned to slide into an aperture in the escutcheon 22. As the square mounting 54 is slid into position, the associated ridges 56 are deformed or crushed to provide a tight fit between the bushing 24 and the escutcheon 22, thereby locking the bushing in a substantially stationary position as shown in FIG. 5A. The escutcheon 22 includes a generally rectangular aperture 58 sized and dimensioned to receive the mounting section 54 of the bushing 24.

Figure 5:
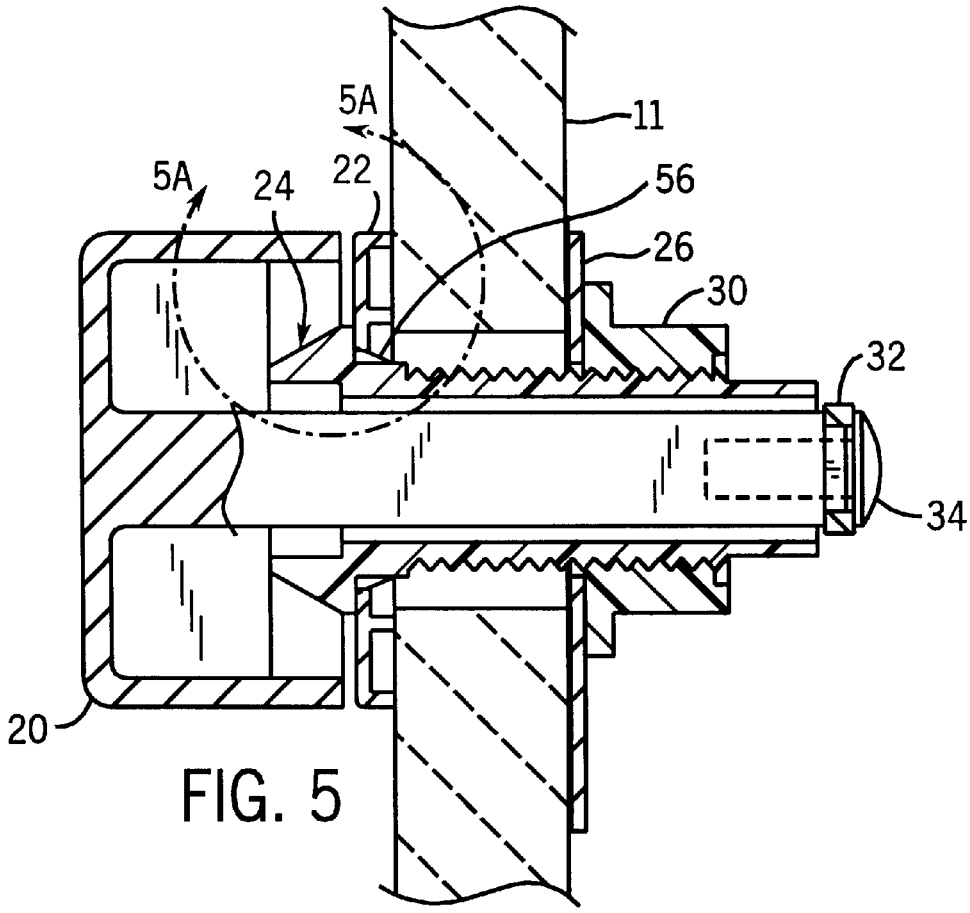
FIG. 5 is a view taken along line 5—5 of FIG. 6.
Figure 5A:
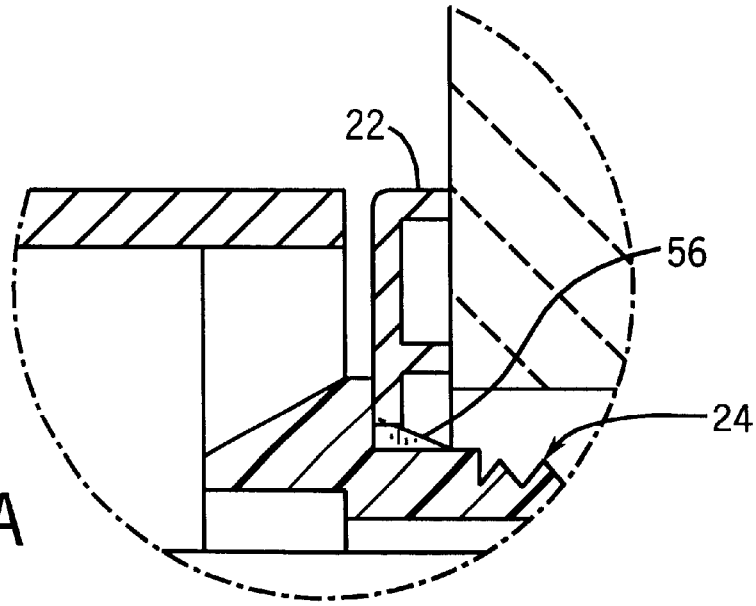
FIG. 5A is a further enlarged view taken of the detail portion 5A—5A of FIG. 5.

Referring now to FIG. 5, the bushing 24 is inserted into the aperture 58 from the front of the escutcheon 22 until the mounting section 54 and associated ridges 56 extend through and are deformed and crushed against the aperture 58 defined in the escutcheon 22 to provide a tight fit, as shown in FIG. 5A. First and second semicircular locating ridges 60 and 62 extend in a generally perpendicular position from the escutcheon 22 and provide a means for locating the escutcheon 22 within the aperture 25 of the tank wall 11.

Figure 7:
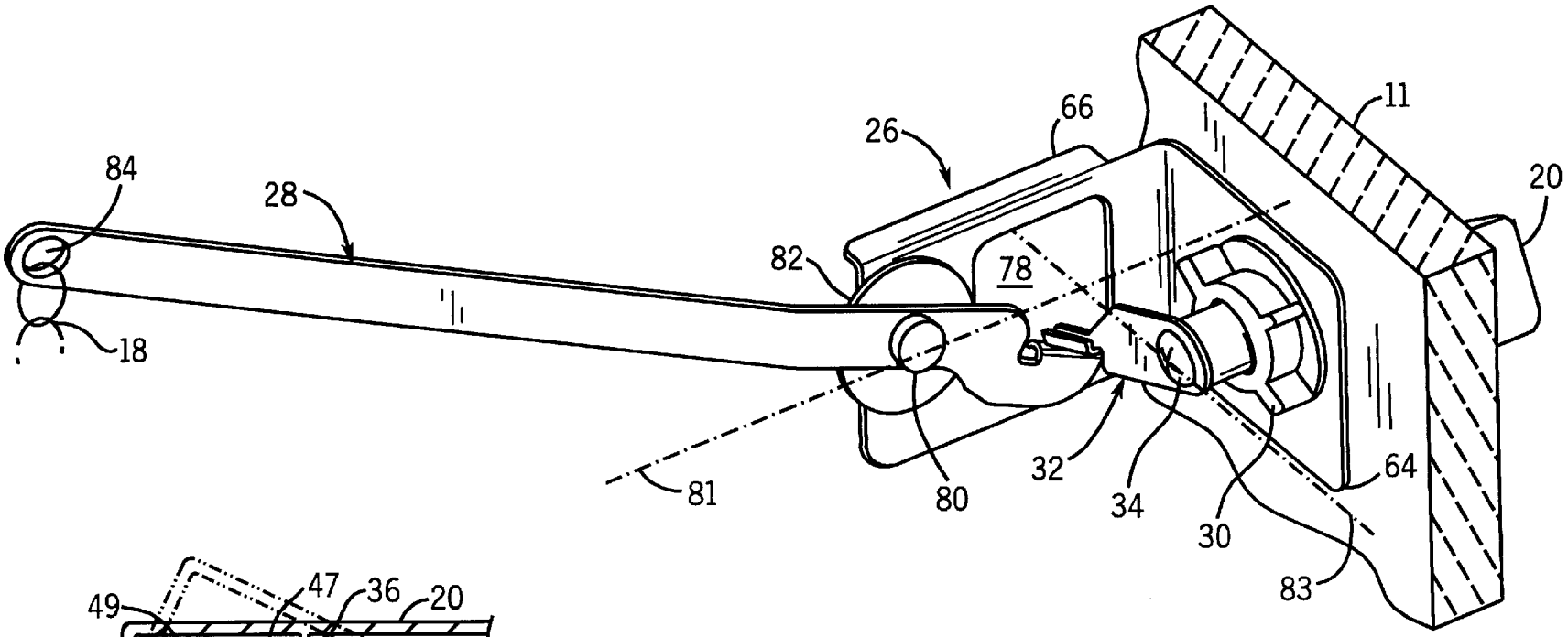
FIG. 7 is a view similar to FIG. 6, but with the valve in a position where the flush valve would be above its seated position so as to be open.
Figure 8:
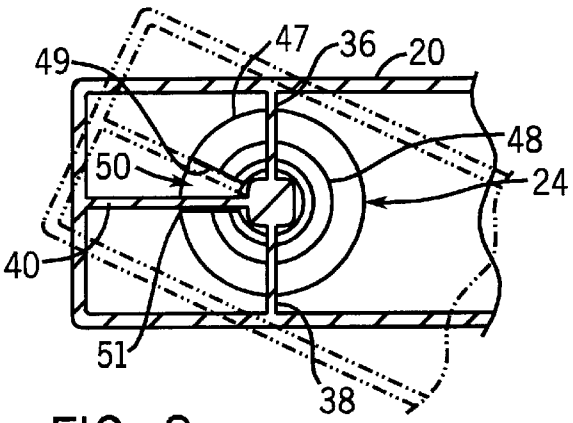
FIG. 8 is a view similar to FIG. 3, but with the handle in the FIG. 7 position in dotted lines.

Referring now to FIG. 7, the L-bracket 26 comprises first and second perpendicular walls 64 and 66. When assembled the first wall 64 is positioned against the internal tank wall 11, in a plane substantially parallel to the tank wall 11. The wall 64 includes an aperture which is positioned around the aperture 25 in the tank wall 11 and which receives the threaded shaft 52 of the bushing 24.

As seen in FIG. 2, the side walls of the aperture 68 each include a rolled tab 74 and 76 which is a piece of the L-bracket 26 which is rolled substantially 90° backwards and is sized and dimensioned to provide a locating element for attaching the L-bracket 26 to the aperture 25 in the toilet wall 11. The aperture 68 further includes vertically-directed tabs 70 and 72 which are used to locate the bushing 24 in the aperture 68 and to limit motion of the bushing 24 vertically.

The second wall 66 extends further into the tank in a direction substantially perpendicular to the tank wall 11. The arm 28 is coupled to the outer side of the wall 66 on the side furthest from the first wall 64 of the L-bracket 26. The arm 28 is coupled to the wall 66 through a glide bearing 82 and a pivot pin 80. The pivot pin 80 can comprise a threaded fastener or other devices known to those of skill in the art, but preferably comprises a rivet which is inexpensive and easy to manufacture.

At a first distal end of the arm 28, an aperture 84 is defined for receiving the usual chain 18 or another linkage for operating the outlet flush valve 14. At the opposing distal end of the arm 28 is a lever section 86 which is activated by the trip pin 32 to activate the arm 28.

The location of the pivot point defined by the pin 80 is provided in the L-bracket 26 at a location selected to provide a relatively large movement of the aperture 84 for a minimal rotation of the lever section 86. Furthermore, the lever section 86 is vertically offset from the axis 81 (FIG. 7) at a location vertically below the pivot pin 80, thereby also aiding in providing a flush with a small axis of rotation of the handle. The top of the lever section 86 is rolled, providing a surface of contact between the lever section 86 and the rotation trip pin 32. The lever section 86 is accessible to the trip pin 32 through an aperture 78 in the wall 66 of the L-bracket 26.

The rotatable trip pin 32 mounts on the square mounting post 44 of the stem 42 of the handle 20. The rotatable trip pin 32 further comprises a lever section 90 which, as described with reference to the lever section 86 above, comprises a rolled surface. The trip pin. 32 is aligned along an axis 83 (FIG. 7) substantially parallel to the tank wall 11.

Assembly of the device can be achieved quickly, and without requiring special tools. The bushing 24 includes crush ribs or ridges 56 which deform as they are slid into the escutcheon 22 to provide a tight fit. The escutcheon 22 further includes locating ridges 60 and 62 which are sized and dimensioned to quickly align the escutcheon with the aperture 25 in the tank wall 11. Similarly, the rolled tabs 74 and 76 in the aperture 78 of the L-bracket 26 provides for simplified alignment of the L-bracket 26 in the aperture 25 of the tank wall 11. Other features which simplify manufacturing include the alignment tabs 70 and 72 in the aperture 78 of the L-bracket 26, which align the bushing 24 in the aperture 25, and the mounting element at the distal end of the stem 42 which mates to the aperture in the trip pin 32.

Furthermore, although these elements simplify alignment of the constituent parts in the trip lever assembly 10, each of these elements includes sufficient "play" to allow for alignment despite variations in the vitreous china used to make the tank. Additionally, the arm 28 preferably comprises a malleable metal material which can be bent as necessary to account for such variations in the tank.

To assemble the trip lever assembly 10, the escutcheon 22 is aligned with the aperture 25 in the tank wall 11. The actuating assembly comprising the handle 20, bushing 24, and trip lever 32 is then slid through the escutcheon 22 and the aperture 25 in the tank wall 11, such that the threaded sleeve 52 of the bushing 24 extends through the aperture 25. The aperture 78 of the L-bracket 26 is aligned over the sleeve 52 and around the aperture 25 from the inside of the tank wall 11, such that the arm 28 extends in a direction substantially perpendicular to the tank wall 11. When the L-bracket 26 and escutcheon 22 are in place, a threaded nut 30 is coupled over the sleeve 52, locking the bushing 24, L-bracket 26, and escutcheon 22 in place on the tank wall 11.

Figure 6:
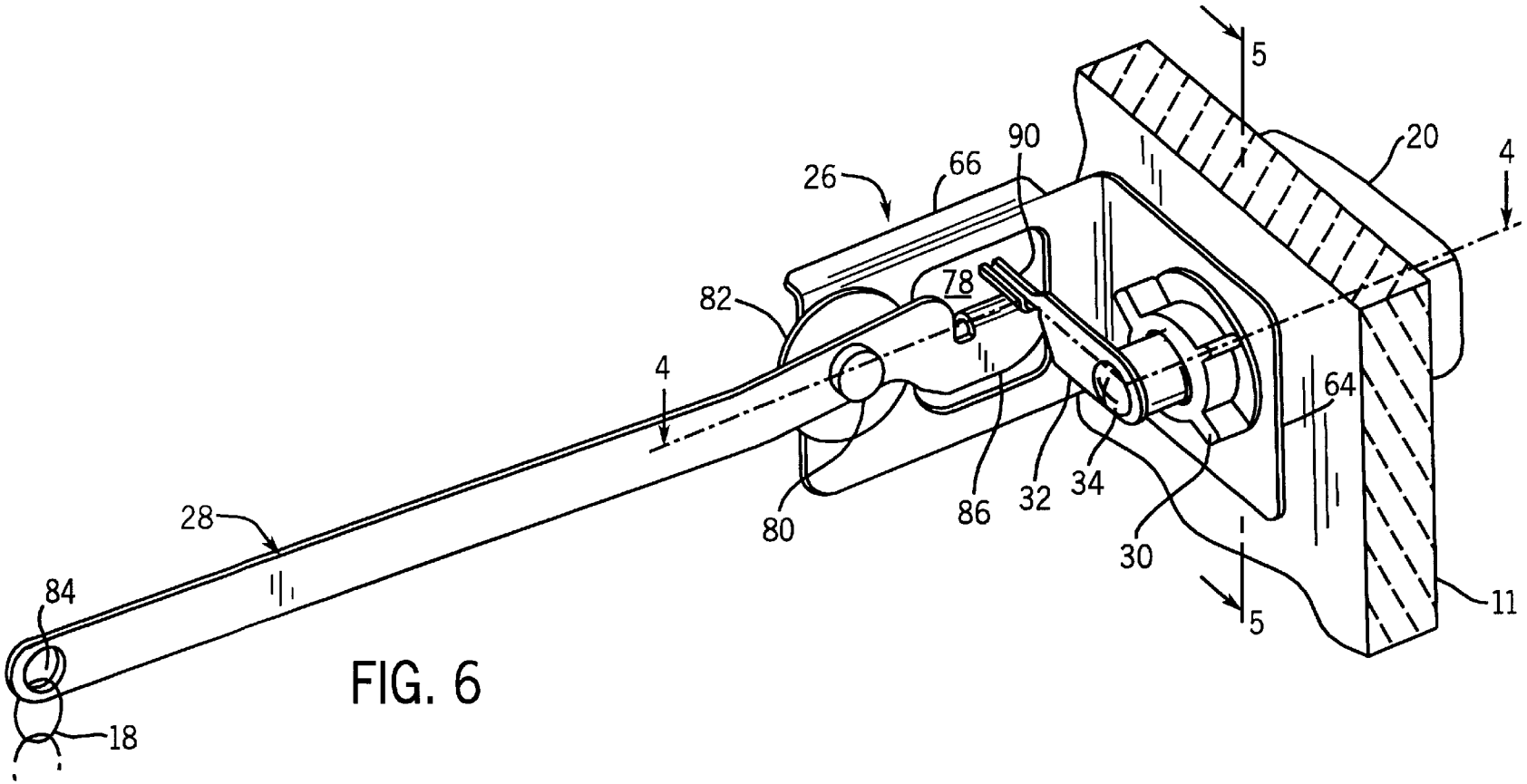
FIG. 6 is a perspective view of the trip lever assembly of the present invention, mounted on a toilet tank wall, and in a position where the flush valve of the tank would be seated in a closed position.

As assembled, the handle 20 aligned such that the horizontal cross bar 40 is positioned in the aperture 50 between the stop surfaces 49 and 51. In operation the handle 20 is turned in a clockwise direction by a user to trigger the lift arm 28 from the "closed" position of FIG. 6 to the "open" position of FIG. 7 thereby selectively flushing the toilet.

As the handle 20 is turned, the horizontal cross bar 40 inside of the handle 20 is rotated about the stem 42. Rotation of the handle 20 is limited by the stop elements 49 and 51 of the bushing 24, which is held stationary by the nut 30, which locks the bushing in place. The stop elements 49 and 51 prevent the horizontal cross bar 40 from rotating beyond a defined angle of rotation, and therefore further prevent unwanted interaction or "clinking" between the metal arm 28 and the top of the toilet tank.

As the handle 20 is turned, the stem 42 is rotated, thereby causing the trip pin 32 to rotate toward the lever section 86 of the arm 28. As the trip pin 32 is rotated, the rolled portion of the trip pin 32 contacts the rolled portion of the lever section 86 causing the arm 28 to pivot about the pin 80 as shown in FIG. 7. Rotation about the pin 80 causes the lever section 86 to rotate downward toward the bottom of the tank and the opposing end of the arm 28, including the aperture 84, to rotate upward toward the top of the tank.

As the aperture 84 moves up, the outlet valve 14 coupled to the valve is lifted, as shown in FIG. 1, causing the water to flush through the pipe 13. The slide bearing 82 limits both noise and friction between the pin 80 and arm 28 as the arm rotates. The rolled surfaces of the trip pin 32 and lever section 86 produce relatively little noise on contact, and further provide a longer-wearing contact surface. Therefore, the design of the present invention provides a relatively quiet but durable construction.

Furthermore, the relative positioning of the pivot point about the pin 80 in the arm 28 assures that a relatively small angle of rotation of the handle will provide a sufficient rise of the aperture 84 to activate the valve 14, and to provide a flush of the toilet. As the operator rotates the handle 20 in a clockwise direction, an angle of rotation in a range of about twenty-eight to thirty degrees effects a flush. Preferably, the angle of rotation is twenty-nine degrees plus or minus half of a degree.

As will be apparent to those of ordinary skill in the art, a preferred embodiment of the invention has been described-above. Modifications and variations to the preferred embodiment may be made within the spirit and scope of the invention. For example, variations in the angle of rotation of the handle and the lift of the arm can be effected by modifying the pivot point of the arm 28, the length of the arm 28, and the position of the stop elements 49 and 51 in the bushing 24. Furthermore, although a rectangular handle has been described, handles in a variety of shapes can be employed. Therefore, the invention is not to be limited to the described embodiment. To ascertain the full scope of the invention, the following claims should be referenced.

Industrial Applicability

The present invention provides a toilet trip lever assembly.

We claim:

1. A trip lever assembly mountable through a hole of a tank wall, comprising:

a rotatable stem extendable through the hole;

a handle mountable to an outer end of the stem;

an arm mountable to an inner end of the stem so as to rotate with the stem, the arm then being extendable along the wall;

a support mountable inside the tank; and a lever mounted for pivoting on the support, with the lever then extending essentially perpendicular to the side wall through which the stem extends between a position adjacent that wall towards a position farther away from that wall;

wherein a portion of the arm is positionable directly above at least a portion of the lever such that when the trip lever assembly is mounted through said tank wall hole, rotation of the handle can cause the arm to drive a wall adjacent part of the lever down, and an opposite end of the lever up.

2. The trip lever assembly of claim 1, further comprising a chain linked to the opposite end of the lever, and a flush valve link to the chain.

3. The trip lever assembly of claim 1, wherein the stem is surrounded by a bushing, and the bushing cooperates with the handle to limit rotational movement of the handle.

4. The trip lever assembly of claim 3, wherein the bushing is outwardly threaded, and a nut is provided with internal threads to thread onto the bushing threads.

5. A trip lever assembly mountable through a hole of a tank wall, comprising:

a rotatable stem extendable through the hole;

a handle mountable to an outer end of the stem;

an arm mountable to an inner end of the stem so as to rotate with the stem, the arm then being extendable along the wall;

a support mountable inside the tank; and a lever mountable for pivoting on the support, with the lever then extending from a position adjacent the wall towards a position farther away from the wall;

wherein when the trip lever assembly is mounted through said tank wall hole, rotation of the handle can cause the arm to drive a wall adjacent part of the lever down, and an opposite end of the lever up;

wherein the stem is surrounded by a bushing, and the bushing cooperates with the handle to limit rotational movement of the handle; and wherein the trip lever assembly further comprises an escutcheon positionable adjacent the handle outside the tank wall, the escutcheon having a locating member for locating the escutcheon in the hole of the tank wall.

6. One trip lever assembly of claim 5, wherein the bushing is sized and dimensioned to snap fit in the escutcheon.

7. A trip lever assembly mountable through a hole of a tank wall, comprising:

a rotatable stem extendable through the hole;

a handle mountable to an outer end of the stem;

an arm mountable to an inner end of the stem so as to rotate with the stem, the arm then being extendable along the wall;

a support mountable inside the tank; and a lever mountable for pivoting on the support, with the lever then extending from a position adjacent the wall towards a position farther away from the wall;

wherein when the trip lever assembly is mounted through said tank wall hole, rotation of the handle can cause the arm to drive a wall adjacent part of the lever down, and an opposite end of the lever up;

wherein a contact surface of each of the arm and lever which contact each other are a rolled surface.

8. A trip lever assembly mountable through a hole of a tank wall, comprising:

a rotatable stem extendable through the hole;

a handle mountable to an outer end of the stem;

an arm mountable to an inner end of the stem so as to rotate with the stem, the arm then being extendable along the wall;

a support mountable inside the tank; and a lever mountable for pivoting on the support, with the lever then extending from a position adjacent the wall towards a position farther away from the wall;

wherein when the trip lever assembly is mounted through said tank wall hole, rotation of the handle can cause the arm to drive a wall adjacent part of the lever down, and an opposite end of the lever up;

wherein the support is an L-bracket with a mounting hole for mounting the L-bracket over the hole in the wall, the mounting hole including a rolled tab.

9. A trip lever assembly mountable through a hole of a tank wall, comprising:

a rotatable stem extendable through the hole;

a handle mountable to an outer end of the stem;

an arm mountable to an inner end of the stem so as to rotate with the stem, the arm then being extendable along the wall;

a support mountable inside the tank; and a lever mountable for pivoting on the support, with the lever then extending from a position adjacent the wall towards a position farther away from the wall;

wherein when the trip lever assembly is mounted through said tank wall hole, rotation of the handle can cause the arm to drive a wall adjacent part of the lever down, and an opposite end of the lever up;

wherein the support has a hole into which the arm projects.

10. A combined toilet tank and trip lever assembly, comprising:

a tank having a bottom wall, and surrounding side walls, there being a hole through a side wall;

a flush valve mounted in a lower portion of the tank;

a rotatable stem extended through the hole in the tank side wall;

a handle mounted to an outer end of the stem;

an arm mounted to an inner end of the stem so as to rotate with the stem, the arm then extending essentially parallel to the side wall through which the stem extends;

a support mounted inside the tank; and a lever mounted for pivoting on the support, with the lever then extending essentially perpendicular to the side wall through which the stem extends between a position adjacent that wall towards a position farther away from that wall;

wherein a portion of the arm is positioned directly above at least a portion of the lever such that rotation of the handle causes the arm to drive a part of the lever down, and an opposite part of the lever up.

* * * * *

UNITED STATES PATENT AND TRADEMARK OFFICE

CERTIFICATE OF CORRECTION

PATENT NO. : 6,637,044 B2 
DATED : October 28, 2003
INVENTOR(S) : David K. Rische, Kyle L. Hokel and Virgil S. Eickoff It is certified that error appears in the above-identified patent and that said Letters Patent is hereby corrected as shown below:

Title page, Item [54], and Column 1, line 1,
Title, change "STATEMENT REGARDING FEDERALLY SPONSORED RESEARCH/DEVELOPMENT" to -- TRIP LEVER ASSEMBLY --

Title page,
Item [74], *Attorney, Agent, or Firm* change "Charles" to -- Quarles --

Column 7,
Line 17, change "One" to -- The --

Signed and Sealed this

Sixteenth Day of March, 2004

JON W. DUDAS
*Acting Director of the United States Patent and Trademark Office*